US008186912B2

(12) United States Patent
Saint-Marcoux et al.

(10) Patent No.: US 8,186,912 B2
(45) Date of Patent: May 29, 2012

(54) HYBRID RISER TOWER AND METHODS OF INSTALLING SAME

(75) Inventors: Jean-Francois Saint-Marcoux, London (GB); Jean-Pierre Branchut, Houston, TX (US); Gregoire De-Roux, Paris (FR)

(73) Assignee: Acergy France SA, Suresnes (FR)

( * ) Notice: Subject to any disclaimer, the term of this patent is extended or adjusted under 35 U.S.C. 154(b) by 0 days.

(21) Appl. No.: 12/513,840

(22) PCT Filed: Nov. 6, 2007

(86) PCT No.: PCT/GB2007/050675

§ 371 (c)(1),
(2), (4) Date: Mar. 9, 2010

(87) PCT Pub. No.: WO2008/056185

PCT Pub. Date: May 15, 2008

(65) Prior Publication Data

US 2010/0172699 A1 Jul. 8, 2010

(30) Foreign Application Priority Data

Mar. 10, 2007 (GB) ..... 0704670.9

(51) Int. Cl.
*E02D 5/74* (2006.01)

(52) U.S. Cl. ..... 405/224.2; 405/224

(58) Field of Classification Search ..... 405/169, 405/170, 171, 242.2, 242.4; 441/3, 4, 5; 166/350

See application file for complete search history.

(56) References Cited

U.S. PATENT DOCUMENTS

| | | | | |
|---|---|---|---|---|
| 4,271,550 | A * | 6/1981 | Joubert et al. | 441/133 |
| 4,645,467 | A * | 2/1987 | Pollack | 441/4 |
| 6,321,844 | B1 * | 11/2001 | Thiebaud et al. | 166/345 |
| 6,893,190 | B2 * | 5/2005 | Macrea et al. | 405/209 |
| 2005/0063788 | A1 * | 3/2005 | Clausen | 405/224.2 |
| 2007/0044972 | A1 * | 3/2007 | Roveri et al. | 166/367 |

FOREIGN PATENT DOCUMENTS

| | | |
|---|---|---|
| DE | 39 34 253 (A1) | 4/1990 |
| EP | 0 071 551 (A1) | 2/1983 |
| EP | 0 114 660 (A2) | 8/1984 |
| EP | 1 271 044 (A1) | 1/2003 |
| FR | 2 029 884 | 10/1970 |
| FR | 2 768 457 | 3/1999 |
| FR | 2 809 136 | 11/2001 |
| GB | 1 203 355 | 8/1970 |
| GB | 1 312 544 A | 4/1973 |

(Continued)

*Primary Examiner* — David Bagnell
*Assistant Examiner* — Kyle Armstrong
(74) *Attorney, Agent, or Firm* — Levy & Grandinetti

(57) ABSTRACT

Disclosed is a riser comprising a plurality of pipelines. In one example there are three such pipelines, extending from the seabed toward the surface and having an upper end supported at a depth below the sea surface, wherein, in one embodiment a first of said pipelines acts as a central structural core, the other pipelines being arranged around said first pipeline. In another embodiment three pipelines are arranged around a structural core. In each case, the first of said pipelines may be a fluid injection line, said other pipelines being production lines. Also disclosed is a riser having buoyancy along at least a part of its length, said buoyancy resulting in said riser having a generally circular cross-section, the circumference of which being non-contiguous. Methods of installing such risers are also are also described.

17 Claims, 9 Drawing Sheets

FOREIGN PATENT DOCUMENTS

| | | |
|---|---|---|
| GB | 1 348 318 | 3/1974 |
| GB | 2 173 562 (A) | 10/1986 |
| GB | 2 315 835 (A) | 2/1998 |
| GB | 2 419 171 (A) | 4/2006 |
| WO | WO 99/57413 | 11/1999 |
| WO | WO 01/14687 | 3/2001 |
| WO | WO 02/053869 (A1) | 7/2002 |
| WO | WO 02/063128 (A1) | 8/2002 |
| WO | WO 2004/051051 | 6/2004 |
| WO | WO 2005/103436 (A1) | 11/2005 |
| WO | WO 2006/136960 | 12/2006 |

* cited by examiner

HYBRID RISER TOWER AND METHODS OF INSTALLING SAME

The present invention relates to hybrid riser towers and in particular hybrid riser towers for a drill centre.

Hybrid Riser Towers are known and form part of the so-called hybrid riser, having an upper and/or lower portions ("jumpers") made of flexible conduit and suitable for deep and ultra-deep water field development. U.S. Pat. No. 6,082,391 (Stolt/Doris) proposes a particular Hybrid Riser Tower (HRT) consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background has been published in paper "Hybrid Riser Tower: from Functional Specification to Cost per Unit Length" by J-F Saint-Marcoux and M Rochereau, DOT XIII Rio de Janeiro, 18 Oct. 2001. Updated versions of such risers have been proposed in WO 02/053869 A1. The contents of all these documents are incorporated herein by reference, as background to the present disclosure. These multibore HRTs are very large and unwieldy, cannot be fabricated everywhere, and reach the limit of the component capabilities.

One known solution is to use a number of Single Line Offset Risers (SLORs) which are essentially monobore HRTs. A problem with these structures is that for a drill centre (a cluster of wells), a large number of these structures are required, one for each production line, each injection line and each gas line. This means that each structure needs to be placed too close to adjacent structures resulting in the increased risk of each structure getting in the way of or interfering with others, due to wake shielding and wake instability.

Another problem with all HRTs is vortex induced vibration (alternating shedding of trailing vortexes), which can lead to fatigue damage to drilling and production risers.

The invention aims to address the above problems.

In a first aspect of the invention there is provided a riser comprising a plurality of conduits extending from the seabed toward the surface and having an upper end supported at a depth below the sea surface, wherein a first of said conduits acts as a central structural core, said other conduits being arranged around said first conduit.

Said other conduits are preferably arranged substantially symmetrically around said first conduit.

In a main embodiment said first conduit is a fluid injection line and said other conduits consist of production lines, Said riser preferably comprising two such production lines. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line. Said fluid injection line may be a water or gas injection line.

Said riser may further comprise buoyancy. Said buoyancy may be in the form of blocks located at intervals along the length of the riser. Said blocks may be arranged symmetrically around said first conduit to form a substantially circular cross-section. Said foam blocks are preferably arranged non-contiguously around said first conduit.

Said production lines may provide a pigging loop.

In a further aspect of the invention there is provided a riser comprising three conduits arranged substantially symmetrically around a central core, said conduits extending from the seabed toward the surface and having an upper end supported at a depth below the sea surface, wherein a first of said conduits is a fluid injection line, said other conduits being production lines.

Said production lines may provide a pigging loop.

In a main embodiment said first conduit is a water injection line and said other conduits consist of production lines. Two such production lines may be provided. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line.

Said riser may further comprise buoyancy. Said buoyancy may be in the form of blocks located at intervals along the length of the riser. Said blocks may be arranged symmetrically around said first conduit to form a substantially circular cross-section. Said foam blocks are preferably arranged non-contiguously around said first conduit.

Said riser may further comprise a plurality of guide frame elements arranged at intervals along the length of said riser, said frame elements guiding said conduits in place. Sliding devices between the risers and the guide frames may be included to allow sliding and dampen Vortex Induced Motion.

Said structural core may also be used as a conduit, either as a production line, injection line or gas lift line.

In a further aspect of the invention there is provided a riser comprising a plurality of conduits extending from the seabed toward the surface and having an upper end supported at a depth below the sea surface wherein said riser is provided with buoyancy along at least a part of its length, said buoyancy resulting in said riser having a generally circular cross-section, the circumference of which being non-contiguous.

Generally circular in this case means that the general outline of the riser in cross section is circular (or slightly oval/ovoid) even though the outline is non-contiguous and may have considerable gaps in the circular shape.

Said buoyancy may be in the form of blocks located at intervals along the length of the riser. Said blocks may be arranged symmetrically around said first conduit to form said largely circular cross-section. Said foam blocks are preferably arranged such that there are gaps between adjacent blocks to obtain said non-contiguous profile.

A first of said conduits may act as a central structural core, said other conduits being arranged around said first conduit. Said other conduits are preferably arranged substantially symmetrically around said first conduit. In a main embodiment said first conduit is a fluid injection line and said other conduits consist of production lines. Said fluid injection line may be a water or gas injection line. Alternatively said riser may comprise three conduits arranged substantially symmetrically around a central core, wherein a first of said conduits is a fluid injection line, said other conduits being production lines.

Two such production lines may be provided. At least one of said production lines may be thermally insulated. In one embodiment both production lines are thermally insulated. Alternatively, only one of said production lines is thermally insulated, the uninsulated line being used as a service line. Said thermal insulation may be in the form of a pipe in pipe structure with the annular space used as a gas lift line.

In a further aspect of the invention there is provided a method of installing a riser, said riser comprising a plurality of conduits extending from the seabed toward the surface and having an upper end supported at a depth below the sea surface by a buoyancy module, said riser being assembled at a place other than the installation site and transported thereto in a substantially horizontal configuration wherein said buoyancy module is attached to said riser by a non-rigid connection prior to said riser being upended to a substantially vertical working orientation.

Said connection between the buoyancy module and the riser may be made at the installation site. Said non-rigid connection may be made using a chain. Said chain may be provided in two parts during transportation, with a first part connected to the riser (either directly or indirectly) and a second part connected to the buoyancy module (either directly or indirectly) while being transported. Said parts may be of approximately equal length. Said parts may each be in the region of 10 m to 30 m long. The two parts may be connected together on a service vessel. In order to provide room to make the connection, the buoyancy tank may first be rotated. Said rotation may be through approximately 90 degrees.

Said buoyancy module may be towed to the installation site with the riser. Said buoyancy module may be towed behind said riser by connecting a towing line between the riser and the buoyancy module, independent of any other towing lines.

In one embodiment, in which the riser and buoyancy module are transported together by a first, leading, vessel and second, trailing, vessel the method may comprise the following steps:

- the second vessel, connected by a first line to the top end of the riser during transportation, pays in said line and moves toward the riser,
- the Buoyancy module is rotated approximately 90 degrees,
- the permanent connection between riser and buoyancy module is made on a service vessel;
- a second line, which connected the top of the buoyancy module to the top of the riser during transportation, is disconnected from said riser and passed to said second vessel;
- Said first line is disconnected,
- The riser upending process begins.

Reference to "top" and "bottom" above is to be understood to mean the top and bottom of the item referred to when it is installed.

In a further aspect of the invention there is provided a method of accessing a coil tubing unit located substantially at the top of a riser structure, said riser structure comprising a plurality of conduits extending from the seabed toward the surface and having an upper end supported at a depth below the sea surface by a buoyancy module, wherein said method comprises attaching a line to a point substantially near the top of said riser, and exerting a force on said line to pull said riser, or a top portion thereof, from its normal substantially vertical configuration to a configuration off vertical.

The riser's normal substantially vertical configuration should be understood to cover orientations off true vertical, yet vertical in comparison to other riser systems.

Said buoyancy module may be attached to said riser (directly or indirectly) by means of a non-rigid connection such as a chain. Said line is preferably attached to a lower portion of said buoyancy module. The tension on said line may therefore also cause said buoyancy module to be moved a distance laterally away from the vertical axis of said riser, thereby allowing access to the coil tubing unit from directly above.

Said tension may be exerted on said line by means of a winch or similar device. Said winch may be located on a Floating Production, Storage and Offloading (FPSO) Vessel.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
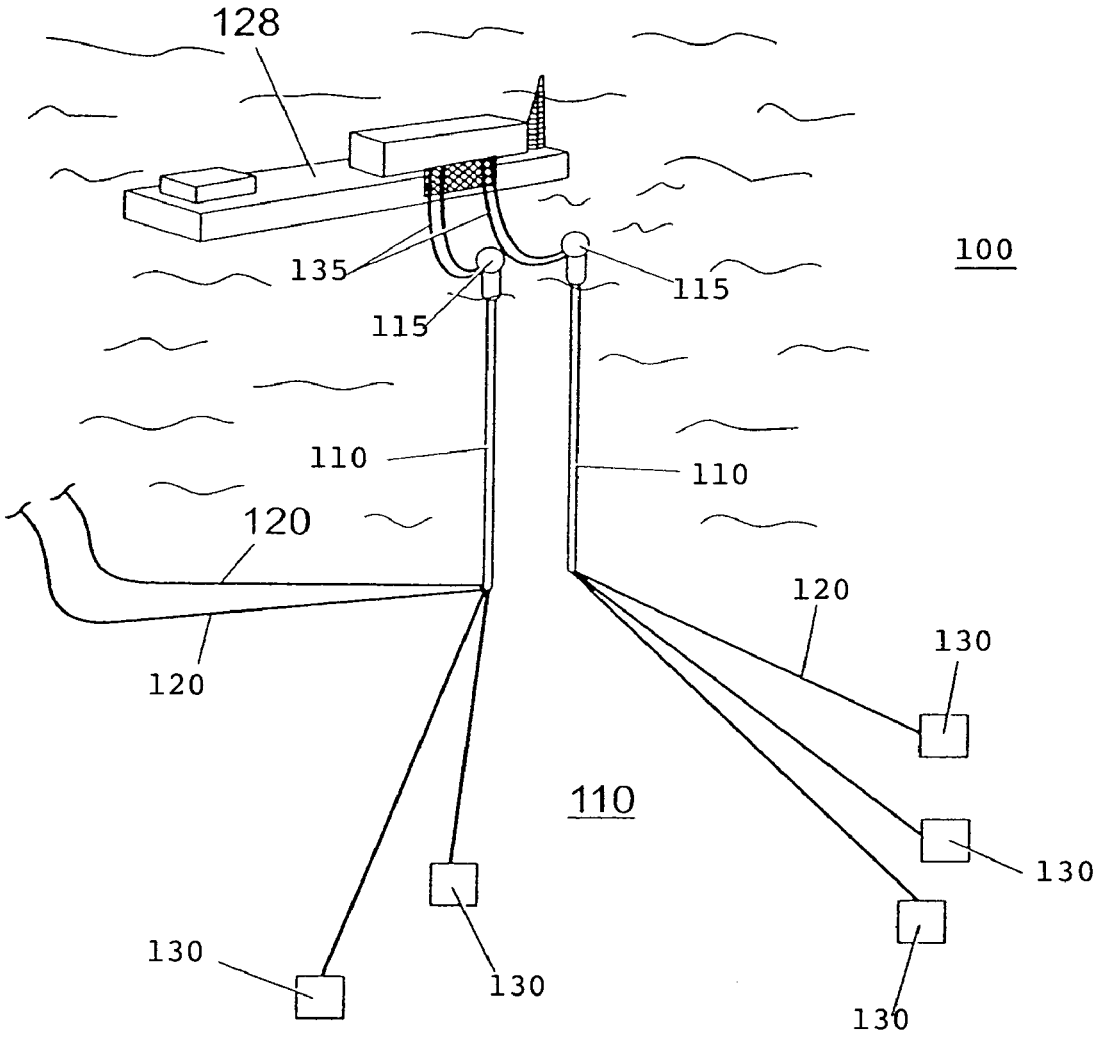
Fig. 1 PRIOR ART
FIG. 1 shows a known type of riser structure in an offshore oil production system.

FIG. 1 illustrates a floating offshore structure 100 fed by riser bundles 110, which are supported by subsea buoys 115. Spurs 120 extend from the bottom of the riser bundle to the various well heads 130. The floating structure is kept in place by mooring lines (not shown), attached to anchors (not shown) on the seabed. The example shown is of a type known generally from the Girassol development, mentioned in the introduction above.

Each riser bundle is supported by the upward force provided by its associated buoy 115. Flexible jumpers 135 are then used between the buoys and the service vessel 128. The tension in the riser bundles is a result of the net effect of the buoyancy combined with the ultimate weight of the structure and risers in the seawater. The skilled person will appreciate that the bundle may be a few meters in diameter, but is a very slender structure in view of its length (height) of for example 500 m, or even 1 km or more. The structure must be protected from excessive bending and the tension in the bundle is of assistance in this regard.

Hybrid Riser Towers (HRTs), such as those described above, have been developed as monobore structures or as structures comprising a number, in the region of six to twelve, of risers arranged around a central structural core.

It is normal for deepwater developments to be phased and are often built around a drill centre. A drill centre is usually of two piggable production lines (at least one being thermally insulated) and an injection line.

Figure 2:
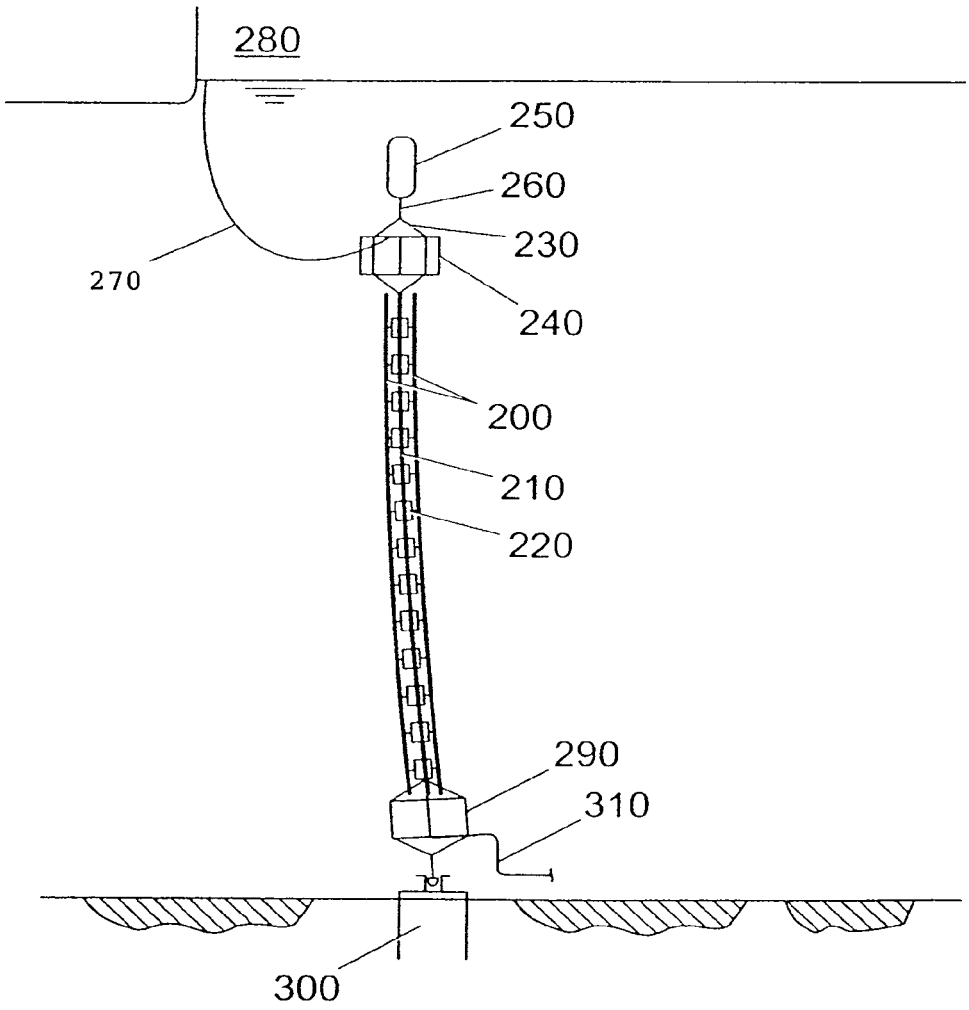
FIG. 2 shows a riser structure according to an embodiment of the invention.

FIG. 2 shows a simplified multibore hybrid riser tower designed for a drill centre. It comprises two (in this example) production lines 200, a water injection line 210, buoyancy blocks 220, an Upper Riser Termination Assembly (URTA) 230 with its own self buoyancy 240, a buoyancy tank 250 connected to the URTA by a chain 260, jumpers 270 connecting the URTA 230 to a Floating Production Unit (FPU) 280. At the lower end there is a Lower Riser Termination Assembly (LRTA) 290, a suction or gravity or other type of anchor 300, and a rigid spool connection 310. This spool connection 310 can be made with a connector or an automatic tie-in system (such as the system known as MATIS (RTM) and described in WO03/040602 incorporated herein by reference). It should be noted that instead of the water injection line 210, the riser tower may comprise a gas injection line.

As mentioned previously, conventional HRTs usually comprise a central structural core with a number of production and injection lines arranged therearound. In this structure. however, the water injection line 210 doubles as a central core for the HRT structure, with the two production lines arranged either side, on the same plane, to give a flat cross-section.

The inventors have identified that for a small isolated reservoir the minimum number of lines required are three, two production lines to allow pigging and one injection line to maintain pressure.

The risers themselves may be fabricated onshore as horizontally sliding pipe-in-pipe incorporating annular gaslift lines, although separate gaslift lines can also be envisaged. The top connection of an annulus pipe-in-pipe can be performed by welding a bulkhead or by a mechanical connection.

Figure 3A:
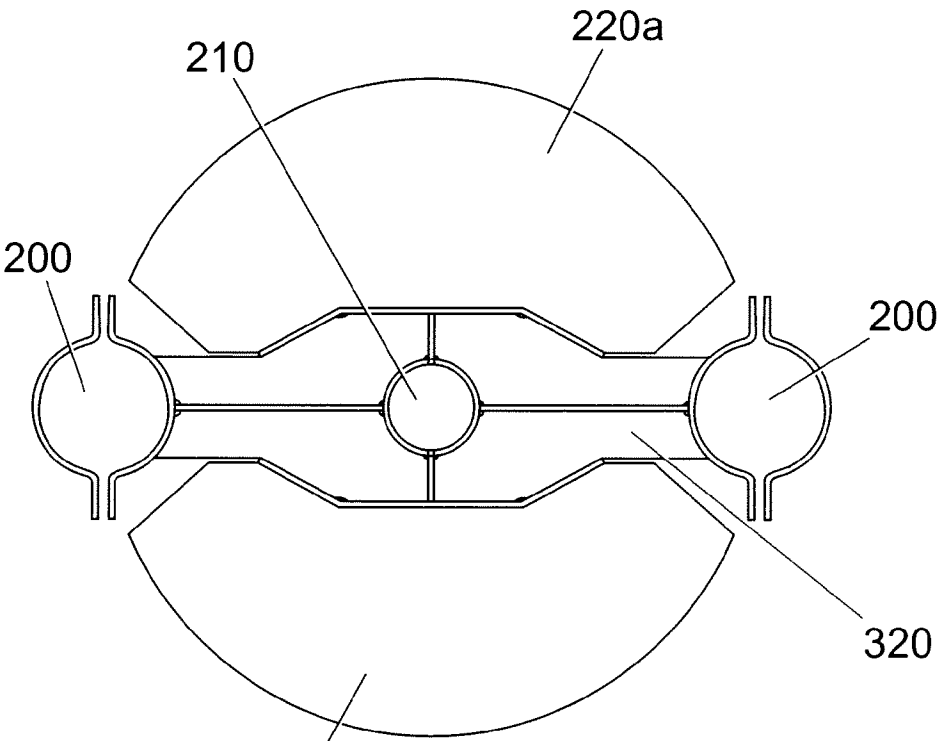
FIGS. 3*a* and 3*b* show, respectively, the riser structure of FIG. 2 in cross section and a section of the riser tower in perspective.
Figure 3B:
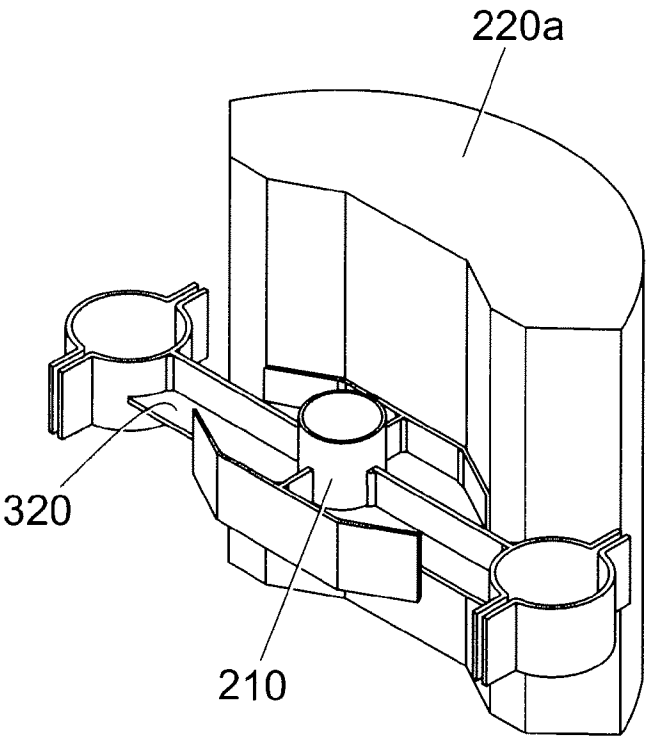

FIGS. 3*a* and 3*b* show, respectively, the riser tower in cross section and a section of the riser tower in perspective. This shows the two production lines 200, the water injection line/central core 210, guide frame 320 and buoyancy foam blocks 220*a*, 220*b*. The guide frame 320 holds the three lines 200, 210 in place, in a line. A plurality of these guide frames 320 are comprised in the HRT, arranged at regular intervals along its length.

It can also be seen that the buoyancy blocks 220*a*. 220*b* are arranged non-contiguously around the water injection line/riser core. For an onshore-assembled HRT, the riser assembly must be buoyant so that, in the event of loss of the HRT by the tugs towing it, it will not sink. Buoyancy of the HRT once installed is provided by the addition of the buoyancy 230 along the riser assemble and the buoyancy provided by the buoyancy element 250 at the top. Attaching buoyancy foam blocks to the risers themselves would reduce the compression in the core pipe but the hydrodynamic section would become very asymmetrical. Therefore, it is preferred for the foam blocks to be attached to the core pipe/ guide frame as shown.

The fact that the foam blocks are arranged non-contiguously around the HRT (as well as being applied non-contiguously along its length) minimises the occurrence of Vortex Induced Vibration (VIV) in the riser tower. A conventional completely circular cross-section causes a wake, while the breaking up of this circular outline breaks the wake, resulting in a number of smaller eddy currents instead of one large one, and consequently reduced drag. The riser cross-section should still maintain a largely circular (or slight ovoid) profile, as there is no way of knowing the water current direction, so it is preferable that the structure should be as insensitive to direction as possible The distance between guide frames is governed by the amount of compression in the core pipe. Guiding devices are required between the guide frame and the riser.

Figure 4A:
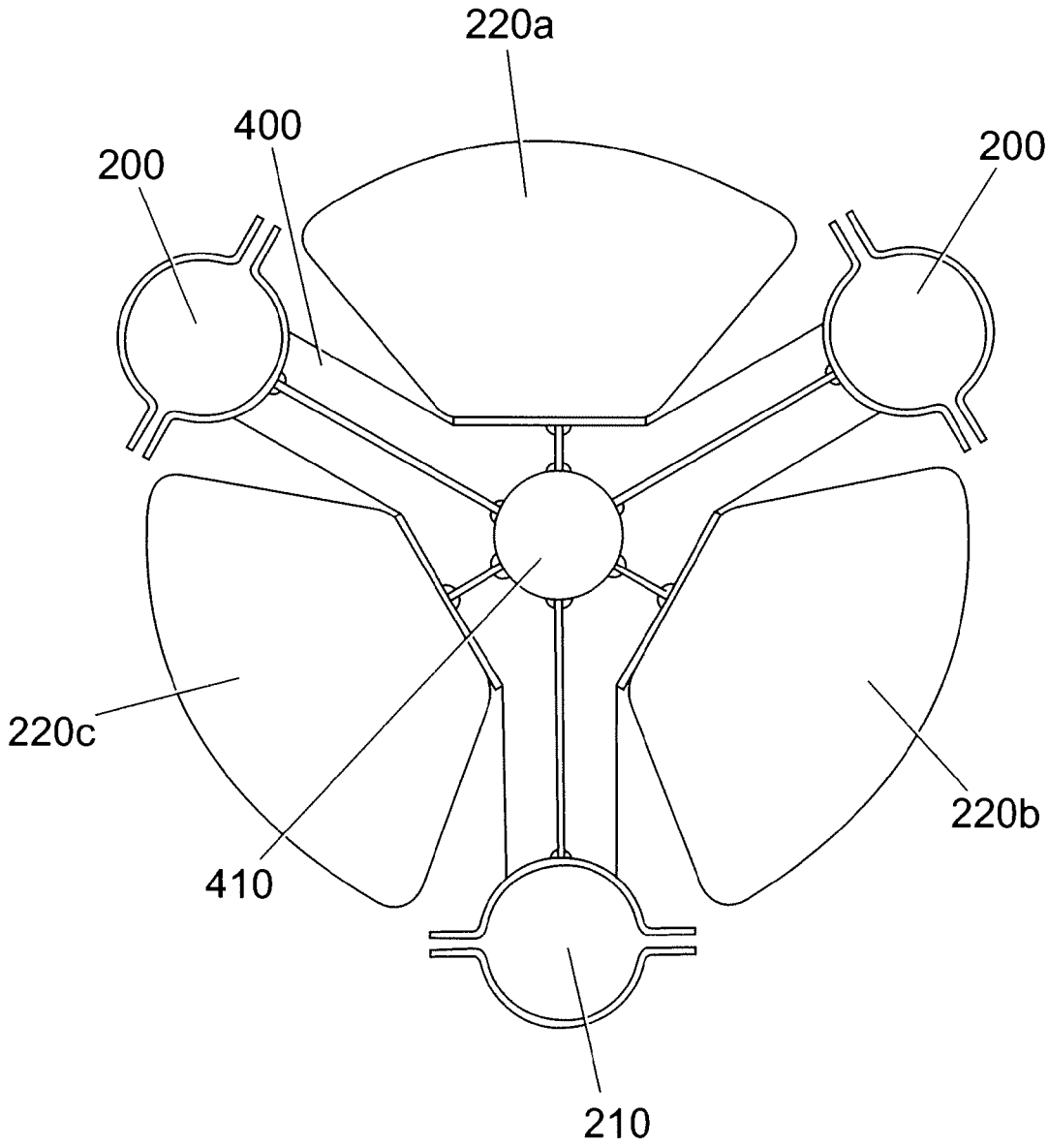
FIGS. 4*a* and 4*b* show, respectively, an alternative riser structure in cross section and a section of the alternative riser tower in perspective.
Figure 4B:
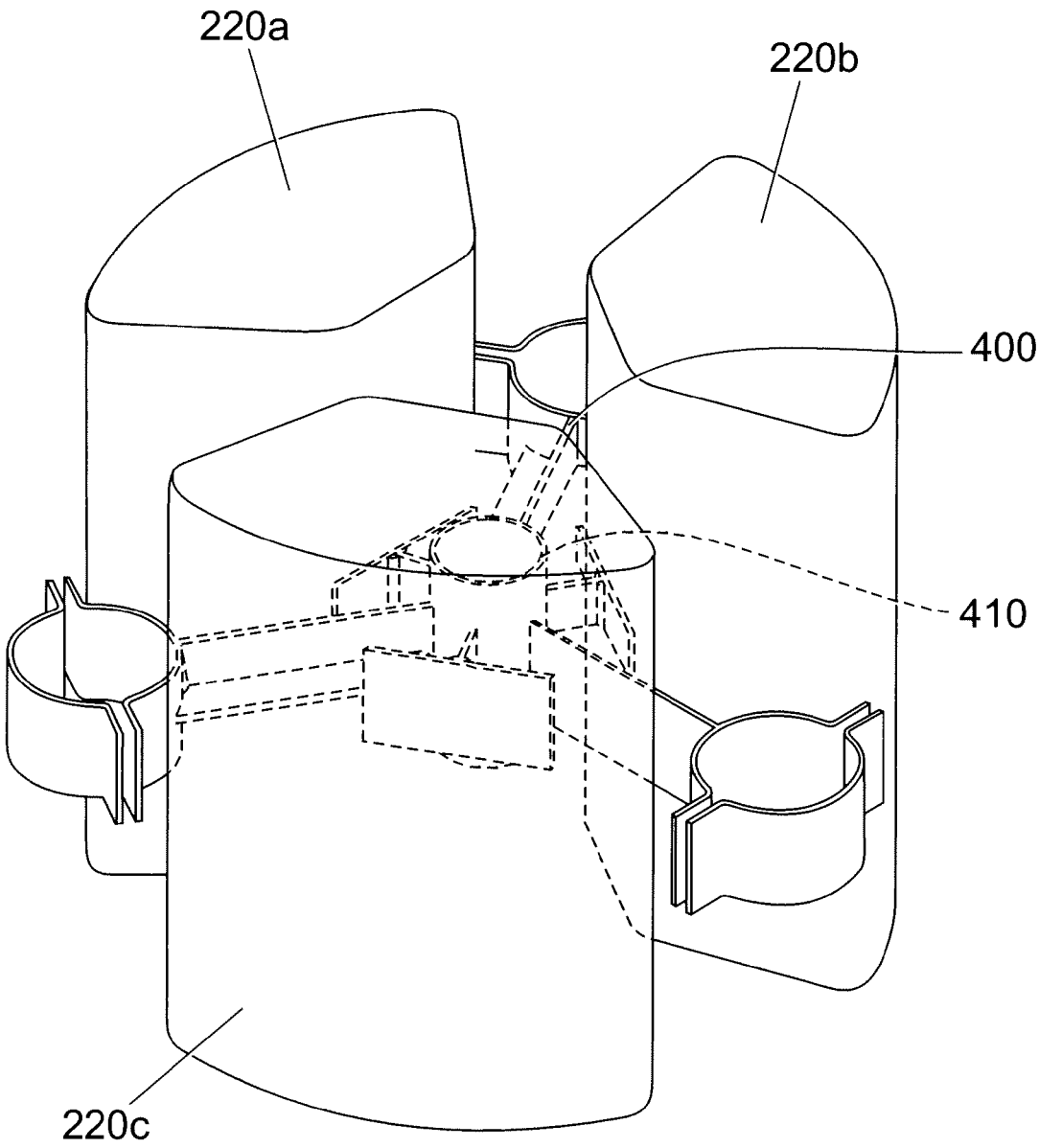

FIGS. 4*a* and 4*b* show an alternative embodiment to that described above wherein the two production lines 200 and the single water injection line/gas injection line 210 is arranged symmetrically around a structural core 410. As before there are guide frames 400 and buoyancy foam blocks 220*a*, 220*b*, 220*c* arranged non-contiguously around the core 410. It is possible in this embodiment for the structural core to be used as a line, should a further line be desired.

Figure 5:
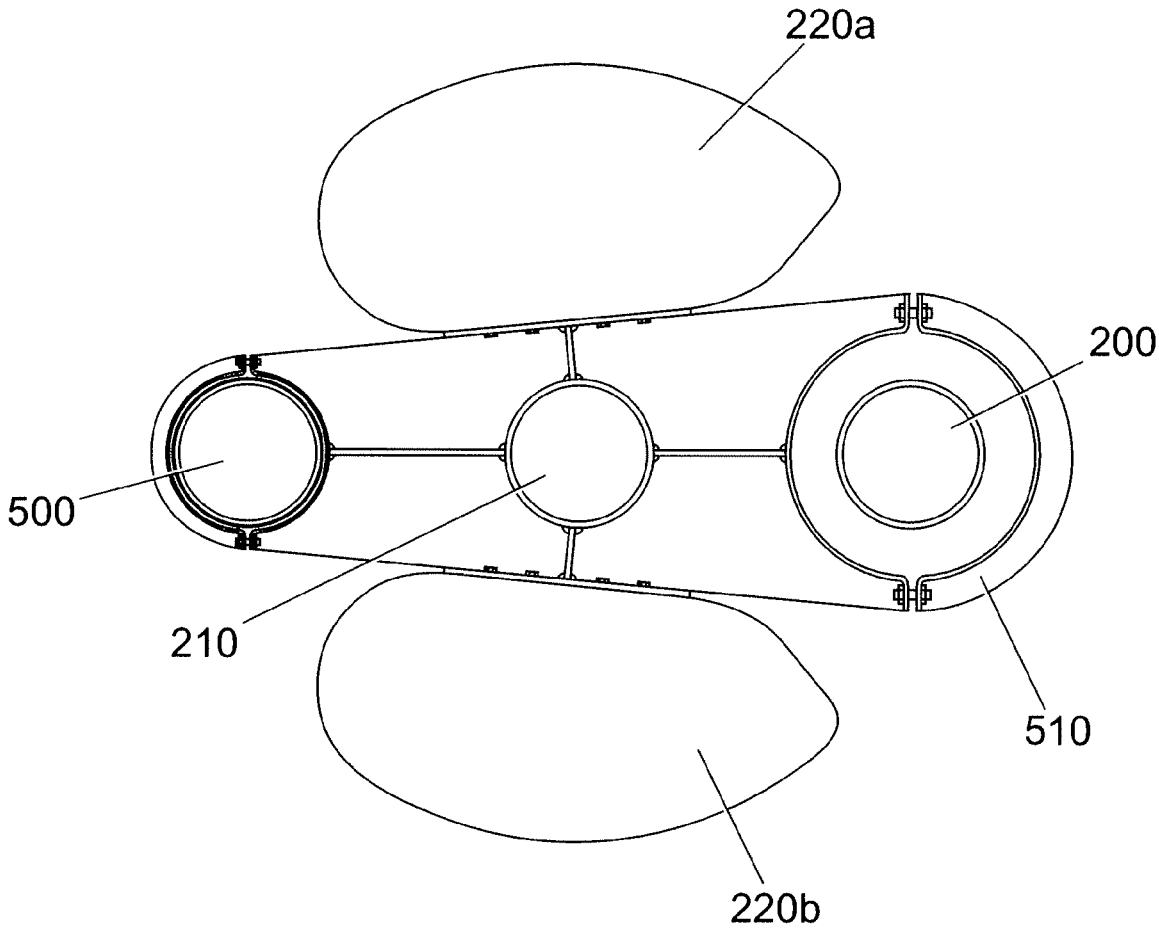
FIG. 5 shows an alternative riser structure in cross-section.

FIG. 5 shows a variation of the embodiment depicted in FIGS. 3*a* and 3*b*. In this variation instead of two identical insulated production lines there is provided only one insulated production line 200 and one non-insulated service line 500. As before, the water/gas injection line 210 acts as the structural core for the riser tower, and there are provided guide frames 510 at intervals along the length with buoyancy blocks 220*a*, 220*b* attached thereto. Under normal conditions the production comes through the insulated line. The service line is always filled with dead oil (not likely to form hydrates). Upon shutdown dead oil from the service line is pushed back into the production line.

It should be noted that the hybrid riser is constructed onshore and then towed to its installation site were it is upended and installed. In order to be towed the riser is made neutrally buoyant (or within certain tolerances). Towing is done by at least two tugs, one leading and one at the rear.

Figure 6:
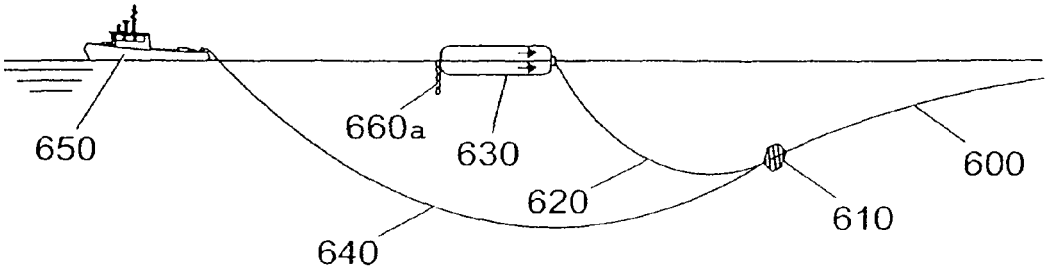
FIG. 6 shows a riser structure with buoyancy tank being towed to an installation site.

FIG. 6 shows (in part) a hybrid riser being towed to an installation site prior to being upended and installed. It shows the riser 600, and at what will be its top when installed, an upper riser installation assembly (URTA) 610. Attached to this via buoyancy tank tow line 620 is the main top buoyancy tank 630 floating on the sea surface. The URTA 610 is also attached to a trail tug 650 (the lead tug is not shown) about 650 meters behind the URTA via riser tow line 640. A section of the main permanent chain link 660*a*, attached to the buoyancy tank 630 and for making the permanent connection between this and the URTA 610, can also be seen, as yet unconnected. It should be noted that the buoyancy tank tow line 620 is actually attached to the top of the buoyancy tank 630, that is the buoyancy tank 630 is inverted compared to the riser 600 itself.

Figure 7:
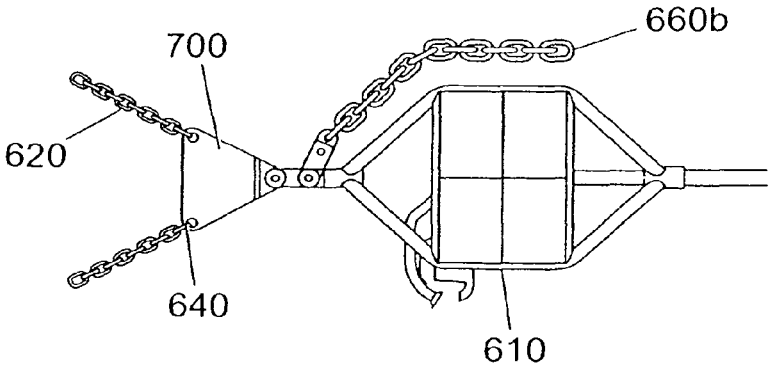
FIG. 7 shows in detail the towing connection assembly used in FIG. 6

FIG. 7 shows in detail the rigging of the URTA 610. This shows a triplate with swivel 700 which connects the URTA 610 (and therefore the riser 600) to the buoyancy tank 630 and trail tug 650 by buoyancy tank tow line 620 and riser tow line 640 respectively. Also shown is the other section of the permanent chain link 660*b* attached to the top of the URTA 610.

By using a chain to connect the buoyancy tank to the riser (instead of, for example a flexjoint) and by making the chain link long enough (say each section 660*a*, 660*b* being about 20 meters in length) it becomes possible to attach the buoyancy tank 630 to the riser 600 by joining these two sections 660*a*, 660*b* together at the installation site prior to upending. This dispenses with the need to have a heavy installation vessel with crane to hold and install the buoyancy tank when upended. Only service vessels are required. It also allows the possibility of towing the buoyancy tank with the riser to the installation site thus reducing cost. Furthermore, the use of a chain instead of a rigid connection dispenses with the need for a taper joint.

Figure 8A:
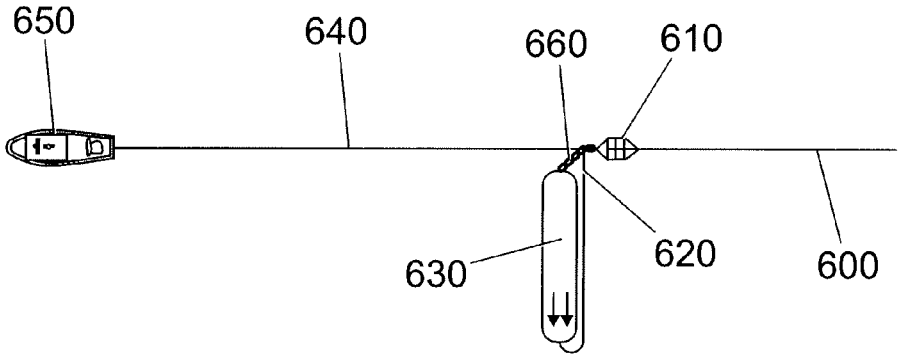
FIGS. 8*a* and 8*b* depict two steps in the installation method according to an embodiment of the invention.
Figure 8B:
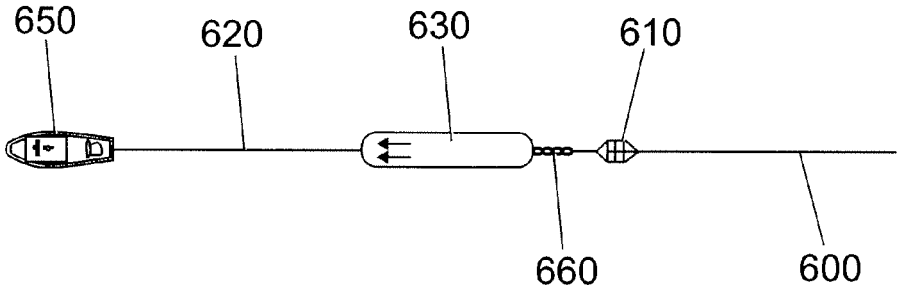

FIGS. 8*a* and 8*b* show the trail tug and apparatus of FIG. 6 during two steps of the installation method. This installation method is as follows: The buoyancy tank is moved back (possibly by a service vessel) and the trail tug 650 pays in the Riser tow line 640 and moves back 150 m towards the riser 600. The paying in of the tow rope causes the URTA 610 to rise towards the water surface. The buoyancy tank 630 is then rotated 90 degrees (again the service vessel will probably do this) to allow room for the permanent chain connection to be made.

With the buoyancy tank 630 rotated, the service vessels pays in the 60*m* permanent chain section 660*a* from the buoyancy tank 630, and the 60*m* permanent chain section 660*b* on the URTA 610. The permanent chain link between the buoyancy tank 630 and the URTA 610 (and therefore the riser 600) is made on the shark jaws of the service vessel. The resulting situation is shown in FIG. 4*a*. This shows the buoyancy tank 630 at 90 degrees with the permanent chain connection 660 in place. The trail tug 650 (now about 100*m* from the URTA 610) is still connected to the URTA 610 by riser tow line 640. The buoyancy tank tow line 620 is still connected between the buoyancy tank 630 and the URTA 610 and is now slack.

The slack buoyancy tank tow line 620 is now disconnected from the triplate swivel 700 and is then passed on to the trail tug 650. Therefore this line 620 is now connected between the trail tug 650 and the top of the buoyancy tank 630. This line 620 is then winched taut. The riser towing line 640 is then released. This situation is shown in FIG. 4*b*. It can be seen that the tension now goes through the buoyancy tank towing line 620, buoyancy tank 620 and permanent chain 660. The triplate swivel 700 is then removed to give room to the permanent buoyancy tank shackle, and the permanent buoyancy tank shackle is secured. The upending process can now begin with the lead tug paying out the dead man anchor. The upending process is described in U.S. Pat. No. 6,082,391 and is incorporated herein by reference.

One issue with the Hybrid Riser Tower as described (with chain connection to the buoyancy tank) is the coil tubing access. This was previously done by having access to the coil tubing unit to be from directly vertically above the URTA. In this case the buoyancy tank was rigidly connected with a taper joint. However access from vertically above is not possible with the buoyancy tank attached to a chain also directly vertically above the URTA.

Figure 9A:
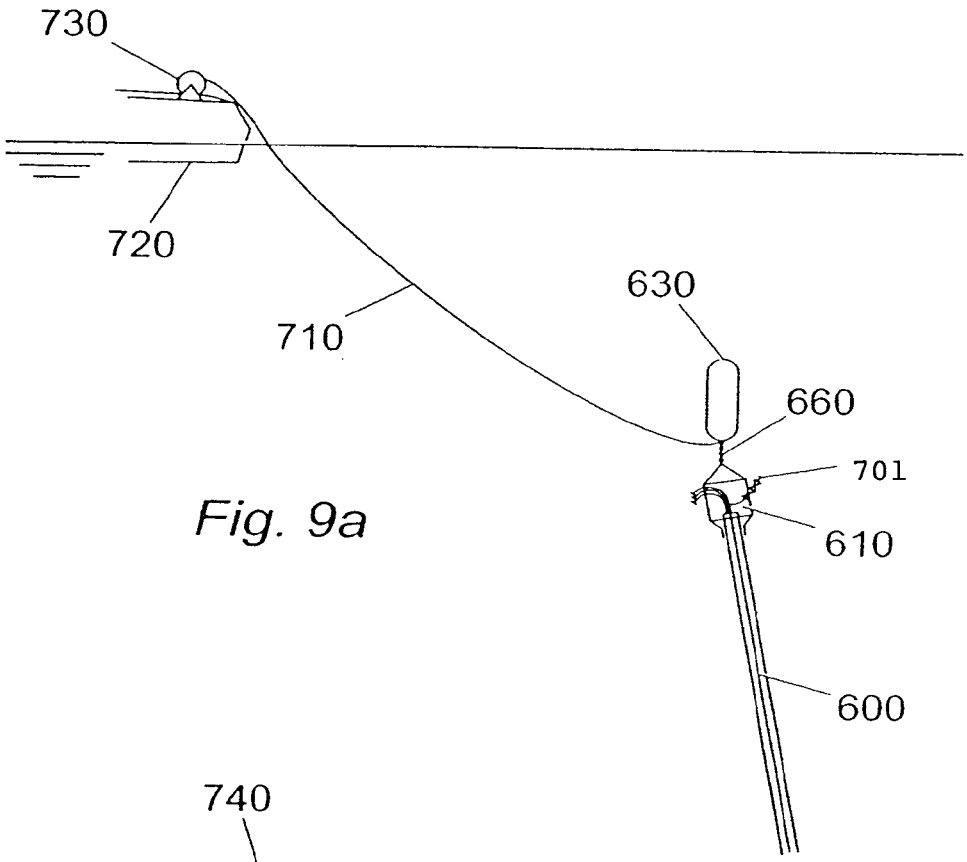
FIGS. 9*a* and 9*b* depict a method for accessing the coil tubing according to a second embodiment of the invention.
Figure 9B:
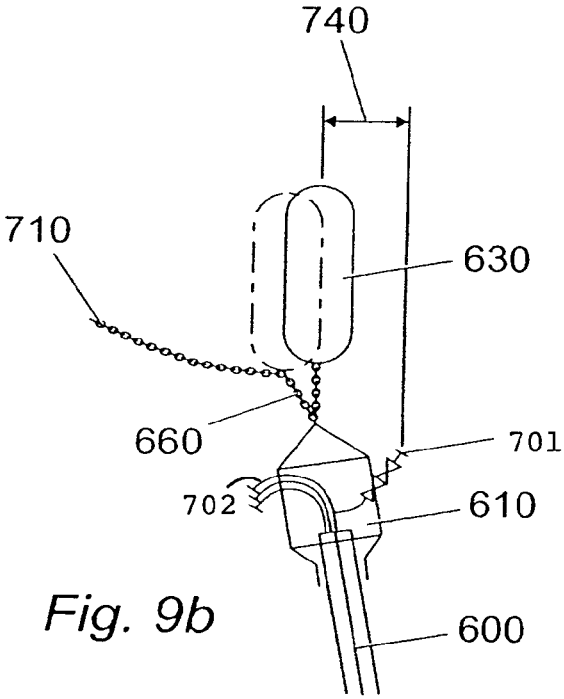

FIGS. 9*a* and 9*b* depicts a method for accessing the coil tubing access unit for a Hybrid Riser Tower which has its buoyancy tank attached non-rigidly, for instance with a chain, as in this example. This shows the top part of the installed riser tower (which may have been installed by the method described above), and in particular the riser 600, URTA 610, buoyancy tank 630, permanent chain link 660, the coil tubing access unit 701, goosenecks 702, and a temporary line 710 from a winch 730 on the Floating Production, Storage and Offloading (FPSO) Vessel 720 to the bottom of the buoyancy tank 630.

The method comprises attaching the temporary line 710 from the winch 730 on the FPSO 720 to the bottom of the buoyancy tank 630 and using the winch 730 to pull this line 710 causing the riser assembly to move off vertical. This provides the necessary clearance 740 for the coil tubing access.

The inventors have recognised that, with the buoyancy tank 630 connected by a chain 660, the temporary line 710 should be attached to the bottom of the buoyancy tank 630. Should it be connected to the top of the buoyancy tank 630, the tank tends only to rotate, while connection to the URTA 610 means that the buoyancy tank 630 tends to remain directly above and still preventing the coil tubing access.

The above embodiments are for illustration only and other embodiments and variations are possible and envisaged without departing from the spirit and scope of the invention. For example it is not essential that the buoyancy tank be towed with the riser to the installation site (although this is likely to be the lower cost option), the buoyancy tank may be transported separately and attached prior to upending.

The invention claimed is:

1. A method of installing a riser, said riser comprising a plurality of conduits extending from the seabed toward the surface and having an upper end supported at a depth below the sea surface by a buoyancy module, said riser being assembled at a place other than the installation site and transported thereto in a substantially horizontal configuration wherein said buoyancy module is attached to said riser by a non-rigid connection prior to said riser being upended to a substantially vertical working orientation, said riser and buoyancy module being transported together by a first, leading, vessel and second, trailing, vessel, the method further comprising the steps of:

connecting said second vessel by a first line to the top end of the riser during transportation and paying in said first line to move toward the riser;

rotating the buoyancy module approximately 90 degrees;

making a permanent connection between said riser and buoyancy module on a service vessel;

disconnecting a second line, which connected the top of the buoyancy module to the top of the riser during transportation, and passing said second line to said second vessel;

disconnecting said first line; and initiating the upending of the riser.

2. A method of installing a riser as claimed in claim 1 wherein said connection between the buoyancy module and the riser is made at the installation site.

3. A method of installing a riser as claimed in claim 1 wherein said non-rigid connection is made using a chain.

4. A method of installing a riser as claimed in claim 3 wherein said chain is provided in two parts during transportation, with a first part connected, directly or indirectly, to the riser and a second part connected, directly or indirectly, to the buoyancy module while being transported.

5. A method of installing a riser as claimed in claim 4 wherein said parts are of approximately equal length.

6. A method of installing a riser as claimed in claim 4 wherein said parts are each in the region of 10 m to 30 m long.

7. A method of installing a riser as claimed in claim 4 wherein the two parts are connected together on a service vessel.

8. A method of installing a riser as claimed in claim 4 wherein, in order to provide room to make the connection, the buoyancy module tank is rotated prior to connection.

9. A method of installing a riser as claimed in claim 8 wherein said rotation is through approximately 90 degrees.

10. A method of installing a riser as claimed in claim 1 wherein said buoyancy module is towed to the installation site with the riser.

11. A method of installing a riser as claimed in claim 10 wherein said buoyancy module is towed behind said riser by connecting a towing line between the riser and the buoyancy module, independent of any other towing lines.

12. A method of accessing a coil tubing access unit located substantially at the top of a riser structure, said riser structure comprising a plurality of conduits extending from the seabed toward the surface and having an upper end supported at a depth below the sea surface by a buoyancy module, wherein said method comprises attaching a line to a point substantially near the top of said riser; and exerting a force on said line to pull said riser, or a top portion thereof, from its normal substantially vertical configuration to a configuration off vertical;

wherein the tension on said line also causes said buoyancy module to be moved a distance laterally away from the vertical axis of said riser, thereby allowing access to the coil tubing access unit from directly above.

13. A method as claimed in claim 12 wherein said buoyancy module is attached, directly or indirectly, to said riser by means of a non-rigid connection.

14. A method as claimed in claim 13 wherein said non-rigid connection comprises a chain.

15. A method as claimed in claim 12, wherein said line is attached to a lower portion of said buoyancy module.

16. A method as claimed in claim 12 wherein said force is exerted on said line by means of a winch or similar device.

17. A method as claimed in claim 16 wherein said winch is located on a floating production, storage and offloading vessel.

* * * * *